US005082052A

United States Patent [19]

Jones et al.

[11] Patent Number: 5,082,052

[45] Date of Patent: Jan. 21, 1992

[54] APPARATUS FOR GRAVEL PACKING WELLS

[75] Inventors: Lloyd G. Jones, Dallas; Charles S. Yeh, Plano; Christopher V. Chow, Dallas, all of Tex.

[73] Assignee: Mobil Oil Corporation, Fairfax, Va.

[21] Appl. No.: 648,061

[22] Filed: Jan. 31, 1991

[51] Int. Cl.[5] ..... E21B 43/04

[52] U.S. Cl. ..... 166/51; 166/278

[58] Field of Search ..... 166/51, 278, 276, 242

[56] References Cited

U.S. PATENT DOCUMENTS

| | | | |
|---|---|---|---|
| 3,434,534 | 3/1969 | Hollabaugh | 166/53 |
| 3,434,540 | 3/1969 | Stein | 166/278 X |
| 3,556,219 | 1/1971 | Meldau | 166/278 |
| 4,018,283 | 4/1977 | Watkins | 166/278 |
| 4,558,742 | 12/1985 | Huang et al. | 166/51 X |
| 4,664,191 | 5/1987 | Jennings, Jr. | 166/276 |
| 4,685,519 | 8/1987 | Stowe et al. | 166/278 |
| 4,932,474 | 6/1990 | Schroeder, Jr. et al. | 166/278 |
| 4,945,991 | 8/1990 | Jones | 166/278 |
| 4,964,464 | 10/1990 | Myers | 166/278 |

FOREIGN PATENT DOCUMENTS

| | | | |
|---|---|---|---|
| 1493749 | 7/1989 | U.S.S.R. | 166/51 |

*Primary Examiner*—Hoang C. Dang

*Attorney, Agent, or Firm*—Alexander J. McKillop; Charles J. Speciale; George W. Hager, Jr.

[57] ABSTRACT

A sand screen is positioned in a well adjacent an oil or gas reservoir to be produced. At least one conduit is in juxtaposition with the sand screen and has passageways at selected intervals to establish fluid communication between the conduit and the annulus of the well surrounding the sand screen. A gravel packing slurry is injected down the well to form a gravel pack in the annulus. Actuatable devices associated with the conduit passageways control fluid flow between the conduit and annulus so that if the gravel portion of the slurry forms a bridge in the annulus, thereby blocking slurry flow through the annulus, the slurry will be diverted from the annulus into the conduit through one or more of the passageways in the conduit above the bridge, downward through the conduit and out through one or more passageways in the conduit into the annulus below the bridge to continue the forming of the gravel pack in the annulus.

11 Claims, 3 Drawing Sheets

APPARATUS FOR GRAVEL PACKING WELLS

BACKGROUND OF THE INVENTION

This invention relates to a method for gravel packing a well that penetrates an unconsolidated or poorly consolidated subterranean oil or gas reservoir.

In the production of hydrocarbons from hydrocarbon-bearing unconsolidated formations, a well is provided which extends from the surface of the earth into the unconsolidated or poorly consolidated formation. The well may be completed by employing conventional completion practices, such as running and cementing casing in the well and forming perforations through the casing and cement sheath surrounding the casing, thereby forming an open production interval which communicates with the formation.

The production of hydrocarbons from unconsolidated or poorly consolidated formations may result in the production of sand along with the hydrocarbons. Produced sand is undesirable for many reasons. It is abrasive to components within the well, such as tubing, pumps and valves, and must be removed from the produced fluids at the surface. Further, it may partially or completely clog the well, thereby making necessary an expensive workover. In addition, the sand flowing from the formation may leave therein a cavity which may result in caving the formation and collapse of the casing.

A technique commonly employed for controlling the flow of sand from an unconsolidated or poorly consolidated formation into a well involves the forming of a gravel pack in the well adjacent part or all of the unconsolidated or poorly consolidated formation exposed to the well. Thereafter, hydrocarbons are produced from the formation through the gravel pack and into the well. Gravel packs have generally been successful in mitigating the flow of sand from the formation into the well.

One of the major problems associated with gravel packing, especially in gravel packing long or inclined intervals, arises from the difficulty in completely packing the annulus between the screen and the casing for in-casing gravel packs or between the screen and the side of the hole for open hole or under-reamed gravel packs. Incomplete packing is often associated with the formation of gravel "bridges" in the interval to be packed which prevent placement of sufficient sand below that bridge, for top down gravel packing, or above that bridge, for bottom up gravel packing. In U.S. Pat. No. 4,945,991 to Jones the problem associated with bridge formation is circumvented by permitting separate pathways for sand laden slurry to reach locations above or below the gravel bridge or bridges.

SUMMARY OF THE INVENTION

In accordance with the present invention, there is provided new and improved apparatus for gravel packing a well that penetrates a subterranean formation adjacent an oil or gas reservoir which is to be produced.

More particularly, a sand screen is positioned in a well in juxtaposition with an oil or gas reservoir to be produced, an annulus being formed in the well surrounding the sand screen. At least one conduit is in juxtaposition with the sand screen and contains openings at selected intervals to establish fluid communication between the conduit and the annulus. A fluid slurry containing gravel is injected down the annulus with the fluid portion of the slurry being forced out of the annulus into the reservoir and the gravel portion of the slurry forming a gravel pack in the annulus surrounding the openings in the production tubing. Actuatable devices associated with the openings in the conduit control fluid flow between the conduit and the annulus so that if the gravel portion of the slurry forms a bridge in a portion of the annulus adjacent the conduit, thereby blocking the flow of slurry through the annulus, the slurry will be diverted from the annulus into the conduit through one or more openings in the conduit above the bridge in the annulus, downward through the conduit, and out through one or more openings in the conduit into the annulus below the bridge in the annulus to continue the forming of a gravel pack within the annulus below the bridge.

The actuatable devices may be rupture discs, blowout plugs or valves. The valves may be time actuated, pressure actuated, electrically actuated or acoustically actuated.

In a further aspect, actuable valves may be closed to prevent gravel flow between the annulus and the conduit during production of oil or gas from the reservoir from loosening the gravel pack in the annulus.

DESCRIPTION OF THE PREFERRED EMBODIMENT

This invention is directed to an apparatus for gravel packing a well for use in unconsolidated or poorly consolidated formations to control the production of sand from unconsolidated or poorly consolidated formations. More particularly, this invention is concerned with apparatus for preventing incomplete gravel packing associated with the formation of gravel bridges in the annulus to be packed which prevents placement of sufficient gravel packing in the annulus below that bridge, for top down gravel packing, or above that bridge, for bottom up gravel packing.

Figure 1:
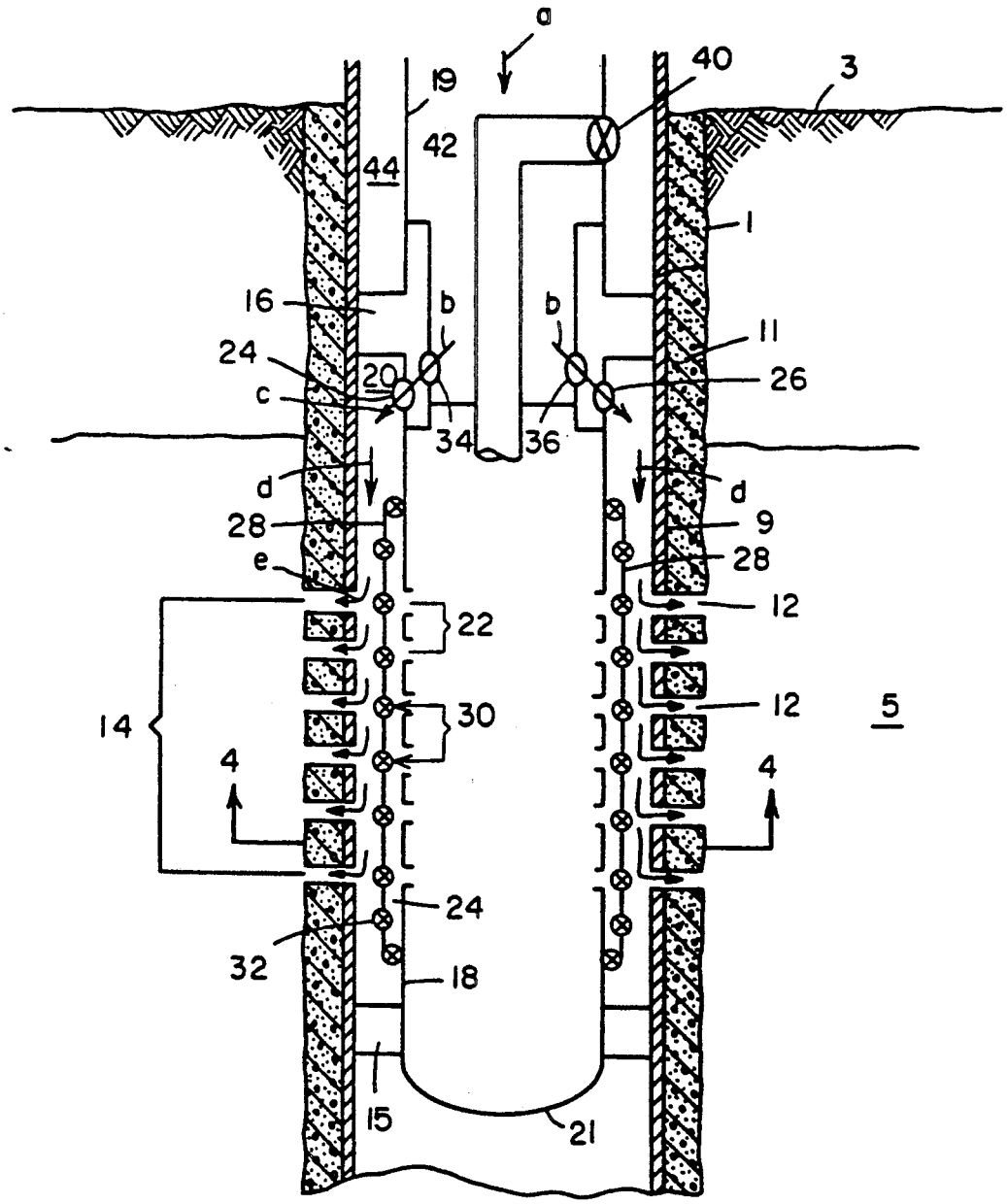
FIG. 1 is a diagrammatic of the gravel packing apparatus of the present invention positioned within a perforated well casing at a location of an unconsolidated or loosely consolidated oil or gas reservoir.

Referring to FIG. 1, there is illustrated one embodiment of a well gravel packing apparatus in accordance with the present invention. With reference to FIG. 1, there is illustrated a well 1 which extends from the surface of the earth 3 into an unconsolidated or poorly consolidated formation 5 containing oil or gas. Well 1 is equipped with a borehole casing 9 that is bonded to the walls of the well by a cement sheath 11. A plurality of perforation tunnels 12 extend through borehole casing 9 and cement sheath 11 at preselected intervals thereby forming an open production interval 14 that provides for fluid communication between the interval of well 1 and a substantial portion of the unconsolidated or poorly consolidated formation 5. The perforation tunnels 12 should have diameters between ⅛ and 1 inch or more, and extend vertically along the longitudinal axis of the borehole casing 9. Gravel packers 15 and 16 are set inside the casing 9 to isolate that portion of the well casing containing perforation tunnels 12 in communication with the oil or gas containing formation 5. A sand screen 18 is located inside borehole casing 9 and in juxtaposition with the perforated tunnels 12 to form an annulus 20 surrounding the sand screen 18. Sand screen 18 comprises a continuous wrapping of wire ribbon (not shown) on the blank pipe 21 or a slotted liner, or other sand retaining devices. The purpose of the sand screen 18 is to allow fluid flow from the formation into pipe 21 while preventing the movement of sand and gravel. With a wire wrapped screen, slots or openings 22 are first cut or drilled in the pipe 21 to allow fluid flow. Metal ribs (not shown) are welded longitudinally on the outside of the pipe 21. Then the wire ribbon is wrapped around the metal ribs in a helical pattern. This type of sand screen is conventional in the industry. Other conventional sand screens include slotted liners or prepacked liners. A typical sand screen is disclosed by Jennings in U.S. Pat. No. 4,664,191, which issued on May 12, 1987 and which is hereby incorporated by reference.

Sand screens generally are manufactured in lengths of 30 feet or less, corresponding to one joint of pipe. Spacing between the wire ribbons in the wire wrap or size of slots in a slotted liner depend on the sand or gravel size whose movement is to be prohibited. At least one inch of radial clearance is desirable between the sand screen and the casing 9. The blank pipe 21 usually extends above the wire ribbons.

The sand screen 18 is supported from a conventional gravel packer 16. Such a gravel packer serves two purposes. It controls the path of flow of the gravel packing slurry into the annulus 20 surrounding the sand screen 18 from a conventional cross-over tool 19 through the cross-over ports 24 and 26 during hydraulic fracturing and gravel packing and, along with the gravel packer 16, forms an isolating seal for the annulus 20 during oil or gas production from the reservoir. Other mechanical arrangements may be used to maintain a similar relationship between the formation 5, annulus 20 and sand screen 18.

In the embodiment of the invention shown in FIG. 1, one or more conduits 28 are mounted or incorporated in juxtaposition with the exterior of the sand screen 18 and are of sufficient size to permit the flow of sand or gravel slurry. The conduit 28 extends substantially throughout the distance of the annulus 20 to be gravel packed. Conduit 28 is provided with a plurality of passageways 30 at preselected intervals therealong that extend the length thereof which provide fluid communication between conduit 28 and annulus 20. These passageways are sufficient in number and size to permit the flow of fluid gravel packing slurry between conduit 28 and annulus 20. Actuatable devices 32 are associated with the passageways 30 and may be rupture discs or blow out plugs which can open the fluid communication between conduit 28 and annulus 20 a single time without resealing or, in the alternative, may be automatically actuatable valves which can repeatedly open and close such fluid communication. The use of such devices will be more fully explained hereinafter.

Conduit 28 can consist of a pipe (either circular, square, rectangular, or curved, etc.). Although the conduit 28 may be made of any pressure-resistant material, it is preferably to be made of stainless steel.

The conduit 28 preferably begins at the top, somewhat above, even with, or slightly below the top of the sand screen 18. The conduit 28 preferably ends at the bottom, somewhat above, even with, or below the bottom of the sand screen 18.

Figure 2:
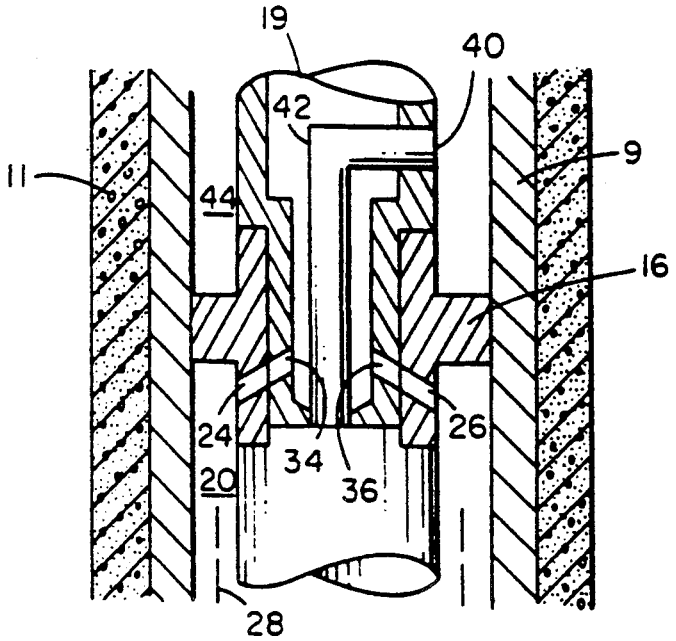
FIG. 2 is a partial cross-sectional view of a portion of the apparatus of FIG. 1.

Referring now to FIG. 2, a slurry of gravel is injected down the well casing 9 through a work string (not shown) into the cross-over tool 19. The term gravel as used herein shall encompass hard, rigid particulate matter ranging in size from very fine sand to pebble size material having a size in the range of 8/12 to 250 mesh, preferably 40/60 mesh. The gravel pack slurry passes through cross-over ports 34 and 36 in the cross-over tool 19, which are in fluid communication with cross-over ports 24 and 26 in the gravel packer 16 and then into annulus 20. Also shown in FIG. 2 is the conventional cross-over port 40 between the wash pipe 42 of cross-over tool 19 and the annular section 44 above the gravel packer 16. Referring again to FIG. 1, cross-over port 40 is closed so as to inhibit the flow of gravel slurry from annulus 20 through the sand screen 18 and upward through the cross-over tool 19 into annular section 44. Consequently, with actuatable devices 32 of conduit 28 closed, all the gravel slurry is forced into annulus 20 and out the perforation tunnels 12 into the surrounding formation 5.

The gravel slurry is injected into the well until annulus 20 surrounding the sand screen 18 is filled with gravel. Referring to FIG. 1, the arrows a–e illustrate fluid flow paths during the gravel packing phase of the present invention. These fluid flow paths are as follows:

a: down the cross-over tool 19,
b: through open cross-over ports 34 and 36 of cross-over tool 19,
c: through open cross-over ports 24 and 26 of gravel packer 16,
d: through annulus 20 and, or, conduit 28, and
e: through perforations 12 into the formation.

Figure 3:
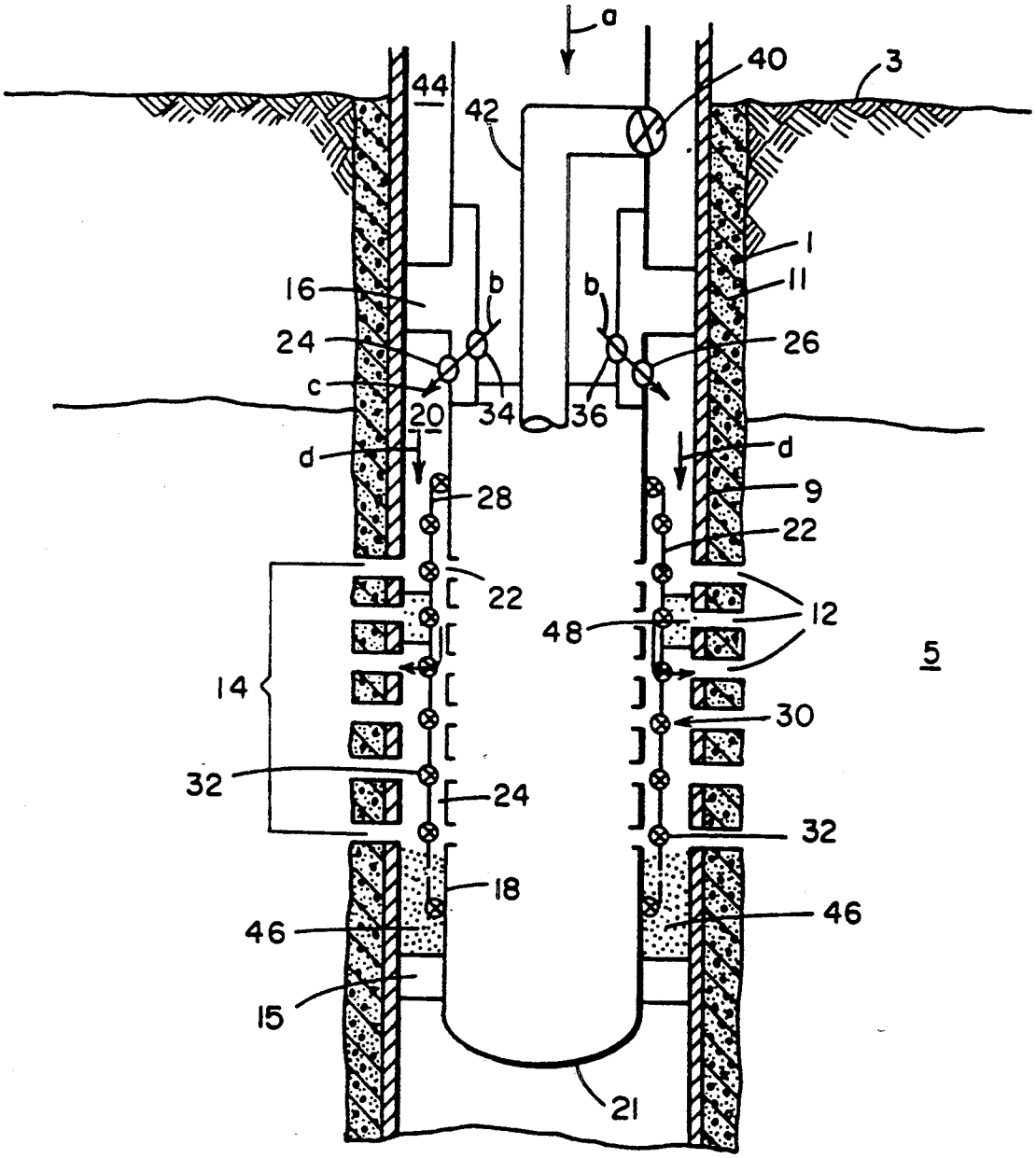
FIG. 3 is a diagrammatic fluid flow pattern illustrating the formation of gravel bridges and use of separate pathways provided by the apparatus of FIG. 1 to circumvent gravel bridge formation.

As injection of the gravel slurry continues, a gravel pack 46 as shown in FIG. 3 begins to fill annulus 20 from the bottom to the top. Due to non-uniformity in the permeability of the formation 5, the fluid portion of the gravel slurry will preferentially flow into the high permeability zones of the formation 5 and a bridge 48 of gravel may occur in the upper portion of annulus 20. At this point in the gravel packing operation, one or more of the actuatable devices 32 located along conduit 28 above and below the bridge 48 of gravel is opened to permit the gravel packing slurry to flow through one or more of the passageways 30 in conduit 28 above the bridge 48 and down through conduit 28, bypassing the gravel bridge 48 and flow out through one or more passageways 30 in conduit 28 below the gravel bridge thereby allowing further placement of gravel packing sand in the annular section 20 below the sand bridge 48. By making the cross-sectional area of conduit 28 smaller than the cross-sectional area of annular section 20, the fluid velocity in conduit 28 will be greater than the fluid velocity in annular section 20 thereby preventing bridging of gravel within conduit 28. No matter how many gravel bridges are formed in annular section 20, the flow of fluid containing gravel is diverted around the gravel bridges until the entire interval in annular space 20 is gravel packed. Thus, the entire annular space 20 is gravel packed using the separate flow channel concept. Instead of injecting the gravel slurry down annulus 20 for packing, as described supra, the gravel pack slurry may be injected down the well and up the annulus 20 to be packed in accordance with gravel packing techniques known in the art.

Figure 4:
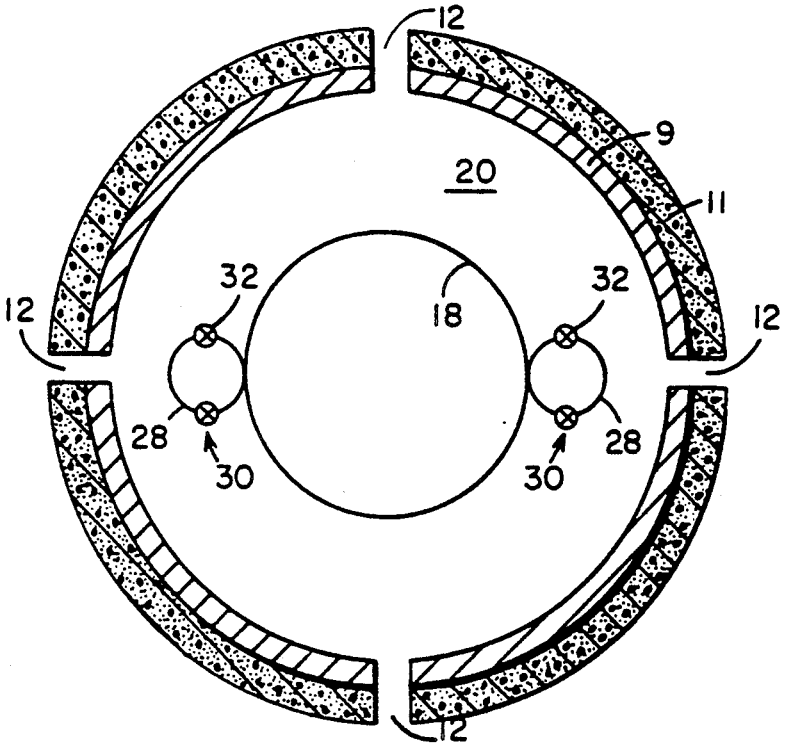
FIG. 4 is a cross-sectional view of the apparatus of FIG. 1 taken along the lines 4—4 of FIG. 1.

Referring now to FIG. 4, and by way of example only, a pair of conduits 28 are positioned on opposite sides of the sand screen 18. Actuatable devices 32, as noted above, may be rupture discs or blow out plugs. When a gravel bridge, such as shown at 48 in FIG. 3, begins to form and causes the pressure in the gravel packing slurry to rise, one or more discs rupture or one or more plugs blow out in the conduit 28 above the bridge 48 to open one or more of the passageways 30 above bridge 48 to the flow of slurry down through the conduit. After the slurry passes the bridge 48, the increased pressure again causes one or more discs to rupture or plugs to blow out in the conduit 28 below bridge 48 to open one or more passageways 30 to the flow of slurry back into the annulus 20 to continue gravel packing below the bridge 48. Automatically actuatable valves may be advantageously used in place of the rupture discs or blow out plugs. Such valves would be useful to maintain gravel pack integrity when production of the oil or gas reservoir is initiated. For example, the valves could be closed after gravel packing is complete so that during production the gravel does not flow from the annulus into the conduit and thereby cause loosening of the gravel pack. If the rupture discs or blow out plugs were used, the passageways 30 could not be closed after gravel packing.

While the rupture discs and blow out plugs allow for simplicity of design and efficiency, automatically actuatable valves allow flexibility in designing the gravel packing operation to improving packing efficiency. The automatically actuatable valves may be pressure actuated, time actuated, electrically actuated or acoustically actuated.

After the gravel pack has been completed, oil or gas production may now be immediately carried out by removal of the cross-over tool 19 and replacement with conventional producing tubing. The fluid flow paths during the production phase is illustrated in U.S. Pat. No. 4,685,519 referenced above and which is hereby incorporated by reference. Also incorporated herein by reference are the teachings of the aforementioned U.S. Pat. No. 4,945,991.

Apparatus of the present invention is also applicable to placing a gravel pack in an open-hole (i.e., unlined) well drilled in an unconsolidated or poorly consolidated subterranean oil or gas reservoir as illustrated in U.S. Pat. No. 3,434,540 and which is hereby incorporated by reference. In this embodiment, a gravel pack is placed in the well to rest against the wellbore in the formation so that fluid flowing from the reservoir passes through the gravel pack. Positioning a conduit or plurality of conduits in the annulus between the sand screen and the wellbore in accordance with the present invention, provides separate flow paths to permit gravel pack slurry to bypass gravel bridges which might build up in the annulus between the sand screen and the reservoir.

Having now described the apparatus of the present invention for gravel packing a well, it is to be understood that various modifications or alterations may become apparent to one skilled in the art without departing from the spirit and scope of the invention as set forth in the appended claims.

We claim:

1. Apparatus for gravel packing a well that penetrates a subterranean oil or gas reservoir, comprising:

(a) a sand screen positioned in said well in juxtaposition with said reservoir, an annulus being formed in said well surrounding said sand screen, (b) at least one conduit positioned in said annulus in juxtaposition with said sand screen and having passageways at selected intervals along said conduit to permit fluid communication between said conduit and said annulus, c) means for injecting a fluid slurry containing gravel down through said annulus whereby the fluid portion of said slurry is forced out of said annulus into said reservoir and the gravel portion of said slurry forms a gravel pack in said annulus surrounding said sand screen, and d) actuatable means associated with said passageways in said conduit for controlling fluid flow between said conduit and said annulus through said passageways such that if the gravel portion of said slurry forms a bridge in a portion of said annulus adjacent said conduit, thereby blocking the flow of said slurry through said annulus, said slurry will flow from said annulus into said conduit through one or more of said passageways in said conduit above said bridge, downward through said conduit, and out through one or more of said passageways in said conduit into said annulus below said bridge to continue the forming of a gravel pack within said annulus below said bridge.

2. The apparatus of claim 1 wherein said actuatable means associated with the passageways of said conduit are actuated to an open position when gravel begins to form a bridge in said annulus to permit said fluid slurry to flow between said annulus and conduit so as to continue the gravel packing of said annulus below said bridge.

3. The apparatus of claim 2 wherein said actuatable means are pressure actuated.

4. The apparatus of claim 3 wherein said means are rupture discs.

5. The apparatus of claim 3 wherein said means are blow out plugs.

6. The apparatus of claim 3 wherein said means are pressure actuatable valves.

7. The apparatus of claim 6 wherein said pressure actuatable valves are actuated at differing pressure differentials along said selected intervals of said conduit.

8. The apparatus of claim 2 wherein said means are time actuatable valves

9. The apparatus of claim 2 wherein said means are electrically actuatable valves

10. The apparatus of claim 2 wherein said means are acoustically actuatable valves.

11. The apparatus of claim 2 wherein said means are actuated to a closed position to prevent gravel flow between said annulus and conduit from loosening said gravel pack during production of said oil or gas reservoir.

* * * * *